US006575105B1

(12) United States Patent
Zingale

(10) Patent No.: US 6,575,105 B1
(45) Date of Patent: Jun. 10, 2003

(54) DEVICE FOR TRANSPORTING LOADS UNDER WATER AND USABLE AS A LIFTING PONTOON

(76) Inventor: Giuseppe Zingale, Via Villini a Mare, 5, 1-95126 Catania (IT)

( * ) Notice: Subject to any disclaimer, the term of this patent is extended or adjusted under 35 U.S.C. 154(b) by 0 days.

(21) Appl. No.: 09/889,673

(22) PCT Filed: Oct. 13, 2000

(86) PCT No.: PCT/IT00/00408

§ 371 (c)(1),
(2), (4) Date: Jul. 19, 2001

(87) PCT Pub. No.: WO01/36266

PCT Pub. Date: May 25, 2001

(30) Foreign Application Priority Data

Nov. 19, 1999 (IT) ..... RM99A0711

(51) Int. Cl.[7] ..... B63C 7/00
(52) U.S. Cl. ..... 114/52; 114/333

(58) Field of Search ..... 114/52, 50, 51, 114/53, 54, 312, 315, 317, 331, 333; 441/1, 2, 32, 33

(56) References Cited

U.S. PATENT DOCUMENTS

| | | | |
|---|---|---|---|
| 3,710,746 | A | 1/1973 | McDonald |
| 4,677,931 | A | 7/1987 | Buckle |
| 5,031,555 | A | 7/1991 | Allen |

FOREIGN PATENT DOCUMENTS

| | | |
|---|---|---|
| GB | 1 491 359 | 11/1977 |

*Primary Examiner*—Jesus D. Sotelo
(74) *Attorney, Agent, or Firm*—Young & Thompson

(57) ABSTRACT

A device for the transport of loads under water which may be used also as a loading bridge, allows to reach great depths under water and comprises a tank (S), two tanks (Sg) and a float (G) in which the pressure automatically remains equal to the external hydrostatic one, due to a valve (V) with four functions that assures the air volume, predetermined in the loading phase, to be constant inside the tank with the variation of the depth.

5 Claims, 3 Drawing Sheets

DEVICE FOR TRANSPORTING LOADS UNDER WATER AND USABLE AS A LIFTING PONTOON

CROSS REFERENCE TO RELATED APPLICATION

This is the 35 USC 371 national stage of international application PCT/IT00/00408 filed Oct. 13, 2000, which designated the United States of America.

FIELD OF THE INVENTION

The present invention concerns a device for the transport of loads under water and that may be used also as a loading bridge.

BACKGROUND OF THE INVENTION

The great difficulties are well known that are met when refloating sunk finds and the remains of incidents or wrecks by means of big balloons or inflatable structures that are coupled to the objects on the ground of the sea for lifting them up, even when they are very heavy. In fact, it often happens that those structures come off the string, loose air and it is rather difficult to manage them when the sea is rough or stormy.

SUMMARY OF THE INVENTION

It is the aim of the present invention to realize a means completely different from all existing means in this field, for the transport of loads under water and that may also be used as a loading bridge.

The aim set forth is reached by means of the device according to the present invention that allows to reach great depths under water without complicated structures, in which the pressure of the tanks and of a float, forming said device, automatically remains equal to the external hydrostatic one, due to a valve with four functions that assures the air volume predetermined in the loading phase to be constant inside the tank with the variation of the depth.

BRIEF DESCRIPTION OF THE DRAWINGS

The present invention will be described more in detail hereinbelow relating to the enclosed drawings in which an embodiment is shown.

DETAILED DESCRIPTION OF THE INVENTION

Figure 1:
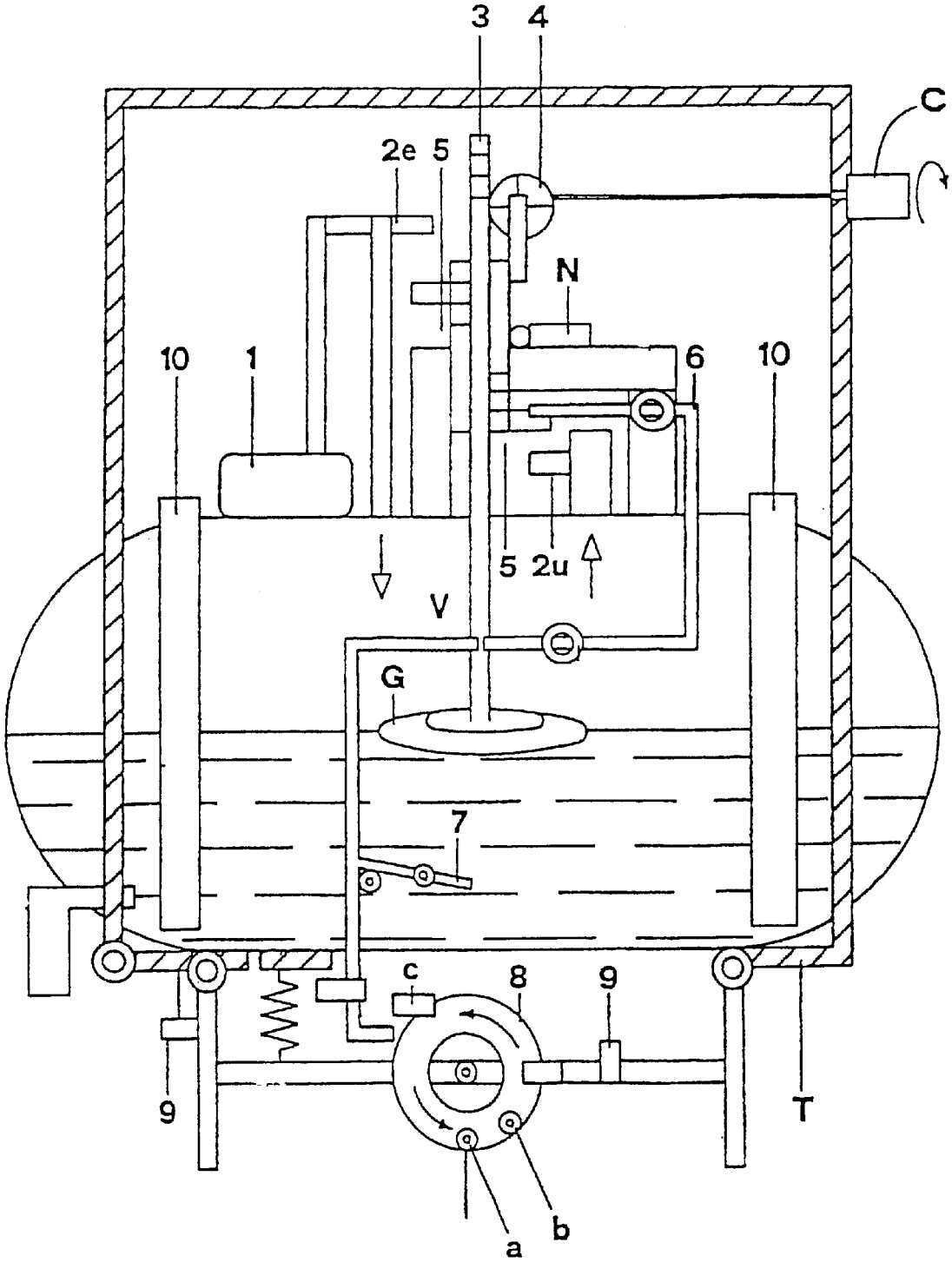
FIG. 1 shows a lateral scheme of a device for the transport of loads under water and that may be used also as a loading bridge, according to the present invention.

The enclosed figures show a device for the transport of loads under water and that may be used also as a loading bridge, in which the pressure in a tank S, in tanks Sg and in the float G always automatically remains equal to the hydrostatic external pressure, due to a valve V that assures the air volume, predetermined in the loading phase, to remain constant inside the tank with the variation of the depth, said valve having the following four functions:

a metric rod 3 determines the air volume Var requested for keeping the load P to be transported in a floating condition; if, e.g., Var=1 cubic meter, the device receives a push upwards of 1,000 kg, coupling a load P equal to 1,000 kg and sinks to the free surface of the water, as it is provided with two floating tanks Sg which have an air volume equal to the weight of the whole structure;

opening of the valve 2*e* for the air inlet into tank S, into tanks Sg and into the float G for keeping constant the air volume and the pressure and thus obtaining the stable floating of the device; reducing the air volume the device receives a push downwards and the water enters pipes 10, and the pressure increases while the device goes down; inside tank S the water level increases so that the float operates valve 2*e* until the internal pressure is equal to the external one and consequently the Var is equal to the predetermined one. The compressed air is supplied by a bottle 1 loaded at least at 200 atm, and between the bottle and the valve a pressure reducer is inserted, set at least at 30% more than the depth to be reached;

opening of the valve 2*u* for the outlet of the air from tank S, which is necessary for allowing the inlet of water through pipes 10 and for making the device come down; said valve 2*u* may also be controlled by an emergency device 6 that intervenes in case of a sudden loss of the transported load;

acceleration and/or braking of the device according to the present invention in its vertical movements, by means of a system 4 of gear-wheels and hand grip C which adjust the position of metric rod 3 and of float G with respect to the oscillating cylinder 5 which, with two adjustable teeth, opens valves 2*e* and 2*u* so that, by means of small rotations of hand grip 4, those small air quantities are let in and/or ejected from tank S for lightening or making heavier the device according to the present invention so as to go up or down, while the spring stabilizing pallet N with a screw for adjusting the pressure of cylinder 5, prevents sudden oscillations of valve V when the device performs vertical movements. When the device moves downwards due to the external pressure, the water volume increases, float G rises and valve 2*e* opens until the predetermined balance of the water level inside tank S is restored; furthermore, as the inlet time of air and water are different, the diameter of pipes 10 is calibrated onto the air speed—for the inlet and for the outlet—, while cylinder 5 has a plurality of grooves so as to be an obstacle to the sliding of pallet N, the adjusting system whereof is fixed at the base. The crank 7 allows the manual opening of the air.

For what concerns the safety system: in case of accidental unhooking of the transported load, the device receives a sudden upward push and, even if valve V intervenes, the Var remains constant with the consequent need of quickly flooding tank S, which may be obtained as follows: pulley 8 has a winding spring inside, and rotates around the axis of the central traverse of frame T; when it is in position a, it means that the weight has been loaded; when the load gets accidentally unhooked, the return spring brings the pulley in position b, the tooth c moves the lever system 6 that lowers cylinder 5 and, by means of a lower tooth, keeps valve 2*u* open: air gets out and water in through pipes 10; if the water inlet through pipes 10 is too slow with respect to the need of stopping the rise of the device according to the present invention in a few meters, an additional quick flooding valve 13 will be operated, placed in the upper part of tank S and shaped for having a great carriage and that will be opened by the depression determined in the tank and by the pressure performed by the water column.

In normal conditions, said valve 13 will be kept closed by the internal pressure and by two small arched steel blades, opportunely calibrated; it has its central pin in the cap and the ends thereof are resting on the edge of the hole in tank S.

Following the flooding of tank S, the device according to the present invention will become heavier but tanks Sg will remain filled with air and will keep it in a stable floating position making it slowly emerge.

If the load to be transported is connected to an emergency rope D, it will be possible to find it. The emergency rope has two functions: it acts as a fishing-line and it slows down the descent of the load and the rising of the device according to the present invention.

The cover 9 blocks wheel 8 in position a in two cases: during loading and when the load is transported onto the upper part of the frame. The safety system works with return spring Mn.

The present invention also provides for a pressurization of the device that may touch great depths because the internal pressure of tank S is always equal to the outer pressure due to valve V, while float G and tanks Sg must be connected with compressed air from compressed air source 1 behind the outlet of valve 2*e* so that said tanks and said float will always be filled with air and with a pressure equal to the one of tank S.

For obtaining an optimal working of the device according to the present invention, the diameter of pipes 10 must be well dimensioned to the one of valves 2*e* and 2*u* for obtaining the movement speed and the intervention time of the emergency system. During the daily use of the device, also adjusting taps at the inlet of pipes 10 may be useful.

For what concerns the loading system of the device for transporting loads under water, it is necessary to well balance the air volume and the water volume for obtaining the maximum safety in the loading phase.

Figure 2:
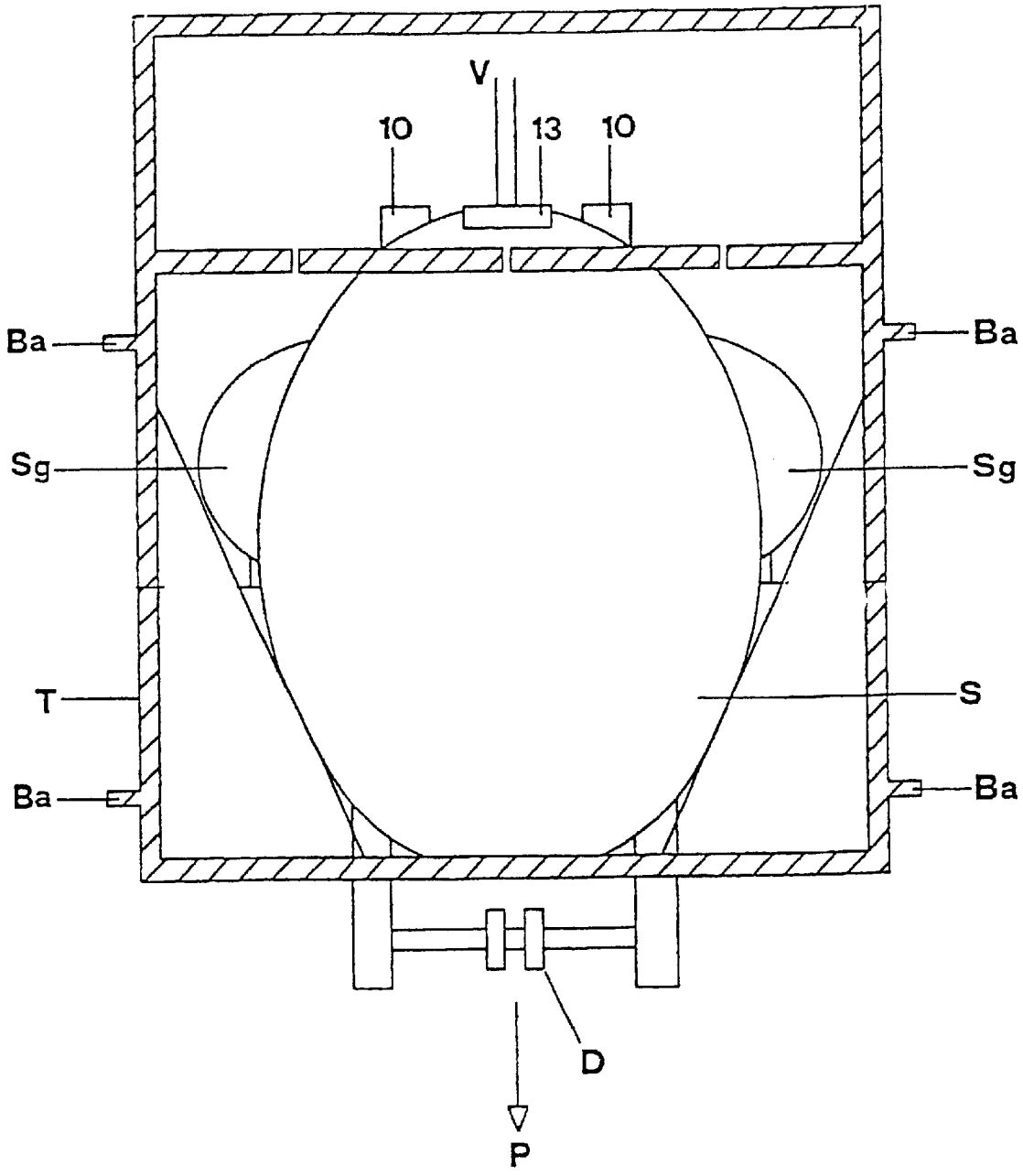
FIG. 2 shows a safety system of the device according to the present invention, as shown in FIG. 1.
Figure 3:
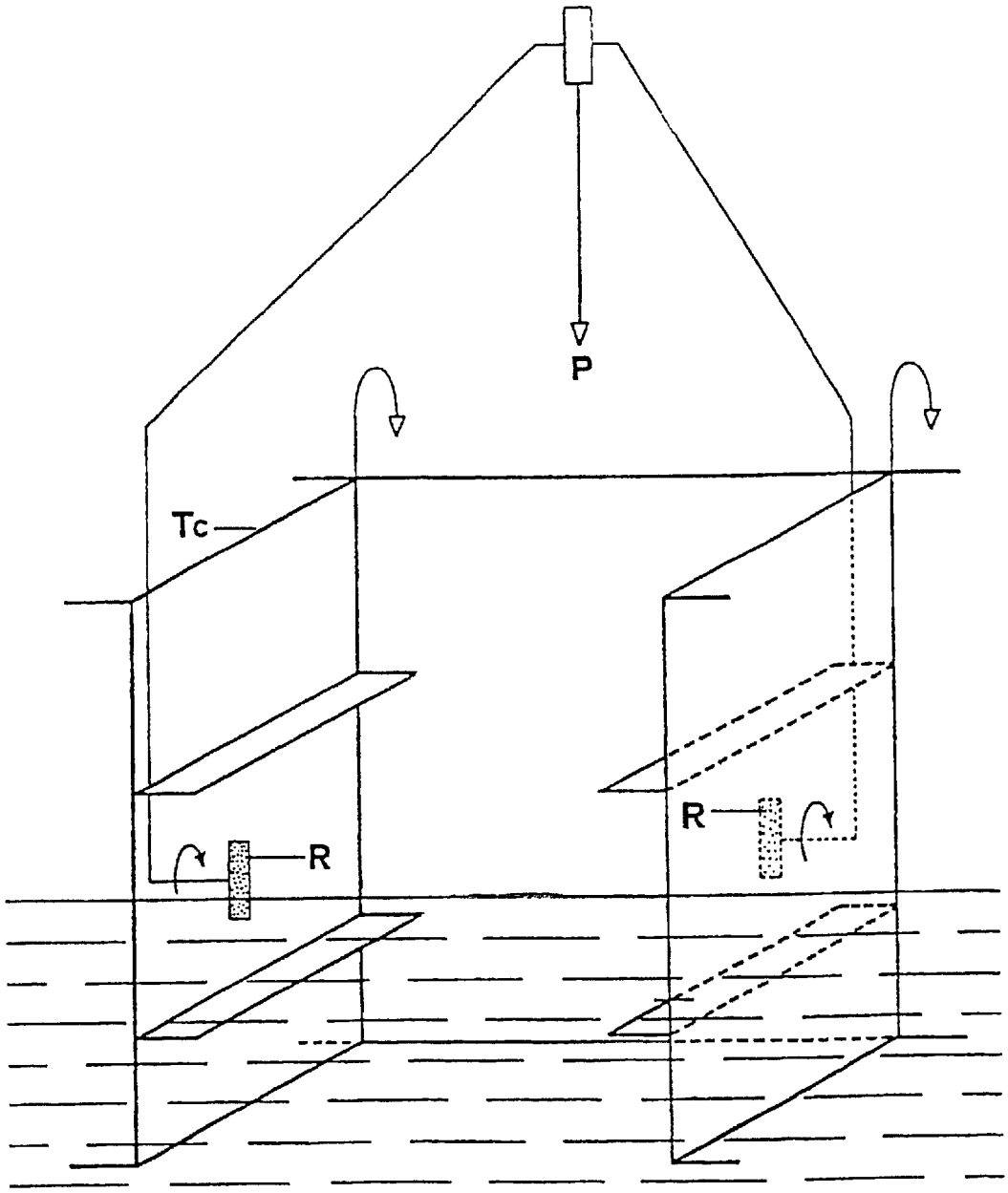
FIG. 3 shows in particular the loading bridge.

For this purpose, it is convenient to combine the loading and/or unloading bridge shown in FIGS. 2 and 3 to the device according to the present invention: the frame T has resting rods Ba, which may be adjusted in height and the position whereof depends on the weight of the load and on the position of loading and/or unloading of the device.

In the mentioned cases, the device according to the present invention changes its position with respect to the loading bridge.

The loading bridge Tc may be laterally coupled to a mole or to a boat.

For making the displacement easier, the device according to the present invention may be provided with propellers and rudders R.

What is claimed is:

1. A device for changing a depth of an object, comprising:

a connection (8) for an object whose depth is to be changed;

a supply (1) of compressed air;

a first tank (Sg) having an air volume corresponding to a weight of the device;

a second tank (S) connected to said first tank and filled with air and water, said second tank having a first opening (10) for passage of water to and from outside said second tank;

a float (G) that floats on water in said second tank; and a valve assembly (V) on said second tank, said valve assembly including, a first valve (2*e*) that selectively connects said supply of compressed air to said second tank, a second valve (2*u*) that selectively releases air from said second tank, a first movable member (5) having a first projection for operating said first valve and a second projection for operating said second valve, and a second movable member (3) connected to said float and whose position relative to said first movable member is adjustable from outside the device, wherein movement of said first movable member in a first direction operates said first valve to increase a buoyancy of the device and movement of said first movable member in a direction opposite the first direction operates said second valve to decrease the buoyancy of the device.

2. The device of claim 1, wherein said first movable member is a cylinder and said second movable member is a rod that moves within said cylinder, and further comprising a gear assembly (4) for moving said rod from outside the device.

3. The device of claim 1, further comprising a damper (N) for damping oscillations of said first movable member.

4. The device of claim 1, wherein said connection comprises a rotatable member that is urged in a first direction when said connection is not connected to an object, and further comprising a lever assembly (6) that is displaced by movement of said rotatable member in the first direction and that is operably connected to said second valve to operate said second valve to decrease the buoyancy of the device when said rotatable member moves in the first direction.

5. The device of claim 4, wherein said rotatable member is a pulley.

* * * * *